US007059922B2

(12) United States Patent
Kawanishi

(10) Patent No.: US 7,059,922 B2
(45) Date of Patent: Jun. 13, 2006

(54) TRIM ANGLE CORRECTION INDICATING SYSTEM FOR OUTBOARD MOTOR

(75) Inventor: Masaru Kawanishi, Hamamatsu (JP)

(73) Assignee: Yamaha Marine Kabushiki Kaisha (JP)

( * ) Notice: Subject to any disclaimer, the term of this patent is extended or adjusted under 35 U.S.C. 154(b) by 0 days.

(21) Appl. No.: 10/969,642

(22) Filed: Oct. 20, 2004

(65) Prior Publication Data

US 2005/0118894 A1 Jun. 2, 2005

(30) Foreign Application Priority Data

Nov. 28, 2003 (JP) ..... 2003-400615

(51) Int. Cl.
*B63H 21/22* (2006.01)

(52) U.S. Cl. ..... 440/1; 440/2

(58) Field of Classification Search ..... 440/1, 440/2, 61 T; 701/21
See application file for complete search history.

(56) References Cited

U.S. PATENT DOCUMENTS 3,641,965 A * 2/1972 Schmiedel ..... 440/2
4,652,878 A * 3/1987 Borgersen ..... 440/2
4,778,414 A 10/1988 Taguchi ..... 440/1
4,855,733 A 8/1989 Koike ..... 340/870.19
4,931,025 A 6/1990 Torigai et al. ..... 440/1
5,094,637 A 3/1992 Nakamura ..... 440/1
5,118,315 A * 6/1992 Funami et al. ..... 440/1
5,167,546 A * 12/1992 Whipple ..... 440/1
5,352,137 A * 10/1994 Iwai et al. ..... 440/1
6,377,879 B1 4/2002 Kanno ..... 701/29

FOREIGN PATENT DOCUMENTS

JP 63-65480 3/1988

* cited by examiner

*Primary Examiner*—Lars A. Olson
(74) *Attorney, Agent, or Firm*—Knobbe, Martens, Olson & Bear LLP

(57) ABSTRACT

A trim angle correction indicating system for an outboard motor indicates the trim angle of an outboard motor accurately even when misalignment of a detector and deviation in detection value occur. A detector detects the trim angle of an outboard motor, and a trim angle indicating section indicates the trim angle detected by the detector. An offset value setting section sets the detection value detected by the detector when the outboard motor is at a reference position as an offset value. A correction processing section corrects the detection value detected by the detector based on the offset value set by the offset value setting section. The trim angle of the outboard motor is indicated in the trim angle indicating section based on the correction value provided by the correction processing section.

11 Claims, 7 Drawing Sheets

TRIM ANGLE CORRECTION INDICATING SYSTEM FOR OUTBOARD MOTOR

CROSS-REFERENCE TO RELATED APPLICATIONS

This application is based on and claims priority to Japanese Patent Application No. 2003-400615, filed Nov. 28, 2003, the entire content of which is hereby expressly incorporated herein by reference.

BACKGROUND OF THE INVENTION

1. Field of the Invention

This invention relates to an angle correction indicating system having a trim angle detector mounted to an outboard motor and having a trim angle indicating section that indicates the trim angle of the outboard motor based on a detection value from the trim angle detector.

2. Description of the Related Art

A conventional outboard motor mounted to the rear of a hull of a boat is rotationally movable in accordance with the running state of the boat. The trim angle of the outboard motor is indicated in a trim angle indicating section located at a boat operating section.

An indicating device that indicates the trim angle of the outboard motor generally has a detector that detects the trim angle and has a trim angle indicating section that indicates the trim angle based on a detection value provided by the detector. The detector and the trim angle indicating section are connected together by transmitting means, as shown, for example, in JP-A-Hei-2-274688.

A swivel bracket is secured to the outboard motor, and a clamp bracket is secured to the hull. When the outboard motor is mounted on the hull, both brackets are connected together to be rotationally movable by a tilt shaft, which enables rotational movement of the outboard motor.

The detector has a base and a detecting section. The detecting section is disposed on the base of the detector for free rotational movement. The detector is mounted in a way such that the clamp bracket is coupled to the base of the detector, and the swivel bracket is coupled to the detecting section. The detecting section moves in relative relation to the base in response to relative movement of the swivel bracket with respect to the clamp bracket.

The detector is adapted to provide an output voltage having a value that changes in accordance with the angle of rotation of the detecting section in relation to the base. The trim angle is detected based on the value of the voltage. If the base and the detecting section are misaligned with the respective brackets of the outboard motor, deviation occurs in the value of the trim angle of the outboard motor. Thus, the detector is first aligned accurately with the outboard motor. The detector is then mounted to the brackets. Further adjustments to the angle at which the detector is mounted are made after mounting, if necessary, as shown, for example, in JP-B-Hei-2-64312.

SUMMARY OF THE INVENTION

The base and the detecting section of the detector are secured to movable parts, such as the brackets for supporting the outboard motor. Thus, accurately mounting the detector to the outboard motor requires time and effort. Furthermore, since the trim angle indicating section is located at the boat operating section, the adjustment work is generally accomplished by two workers. A first worker adjusts the sensor located at the outboard motor, and a second worker checks the indicator and gives instructions. This adjustment work requires time and effort. Furthermore, misalignment may occur, which results in increased occurrences the trim angle being indicated incorrectly.

Deviations may occur in the detection value due to changes to the detector over time, such as, for example, deterioration and wear. The deviations may cause the trim angle to be indicated incorrectly.

Embodiments of a trim angle correction indicating system for an outboard motor in accordance with the present invention overcome the foregoing deficiencies to indicate the trim angle of the outboard motor accurately, even when misalignment of the detector or deviations in the detection value occur.

In particular embodiments, the trim angle correction indicating system includes a detector that detects the trim angle of an outboard motor and a trim angle indicating section that indicates the trim angle detected by the detector. An offset value setting section sets an offset value as the detection value detected by the detector when the outboard motor is in a reference position. A correction processing section corrects the detection value detected by the detector and generates a correction value based on the offset value set by the offset value setting section. The trim angle of the outboard motor is indicated in the trim angle indicating section based on the correction value provided by the correction processing section correcting.

Preferably, the detector is mounted to the outboard motor and is connected to the trim angle indicating section via a network. Also preferably, the offset value setting section and the correction processing section are located in the outboard motor.

The system preferably includes switches for causing the offset value setting section to start an offset value setting operation. The switches are disposed in the trim angle indicating section.

In preferred embodiments, the system includes a stopper that stops the rotational movement of the outboard motor at the reference position. When the rotational movement of the outboard motor is stopped at the reference position for a specified period of time, the offset value is set by the offset value setting section.

BRIEF DESCRIPTION OF THE DRAWINGS

The foregoing features and other features of embodiments in accordance with the present invention are described below in connection with the drawings in which.

DETAILED DESCRIPTION OF THE PREFERRED EMBODIMENT

Figure 1:
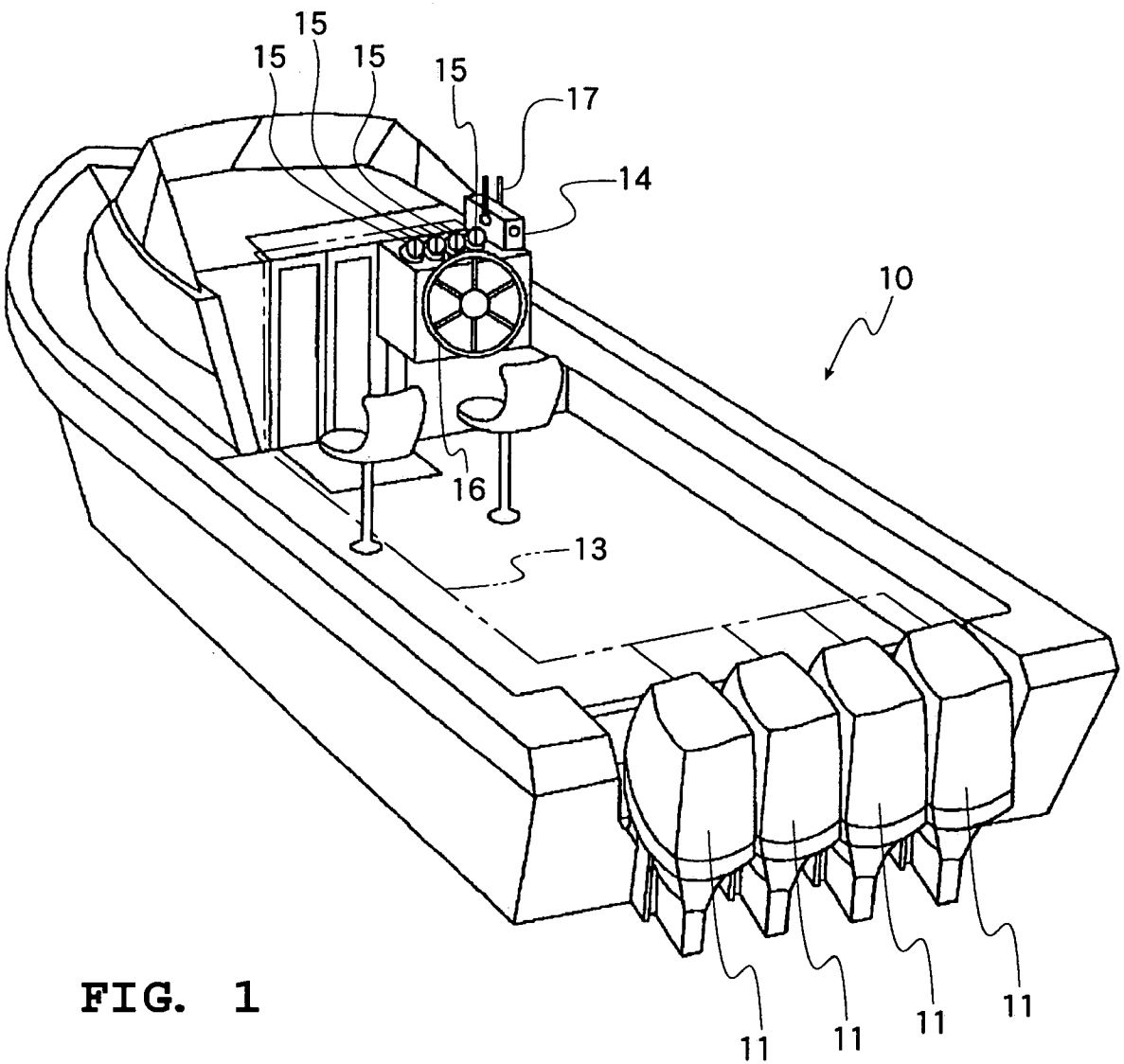
FIG. 1 is a perspective view of a boat equipped with an embodiment of a trim angle correction indicating system for an outboard motor.

FIGS. 1–6 illustrate preferred embodiments of aspects of the present invention. In FIG. 1, a boat 10 has a conventional hull and includes a plurality of outboard motors (e.g., four motors) 11 mounted on the rear of the hull. The boat 10 includes an inboard network system (e.g., a local area network (LAN)). A network cable 13 of the inboard network system is connected to the four outboard motors 11.

A boat controlling section 14 is located in a front portion of the hull of the boat 10. The network cable 13 is connected to a plurality of indicating devices (e.g., four indicating devices) 15 that indicate various information on the outboard motors. The network cable 13 is also connected to a steering device 16, to a remote control 17, and to other devices (not shown) for controlling the boat. The network cable 13 may also be connected to various intelligent devices (not shown), which are not discussed herein.

Figure 2:
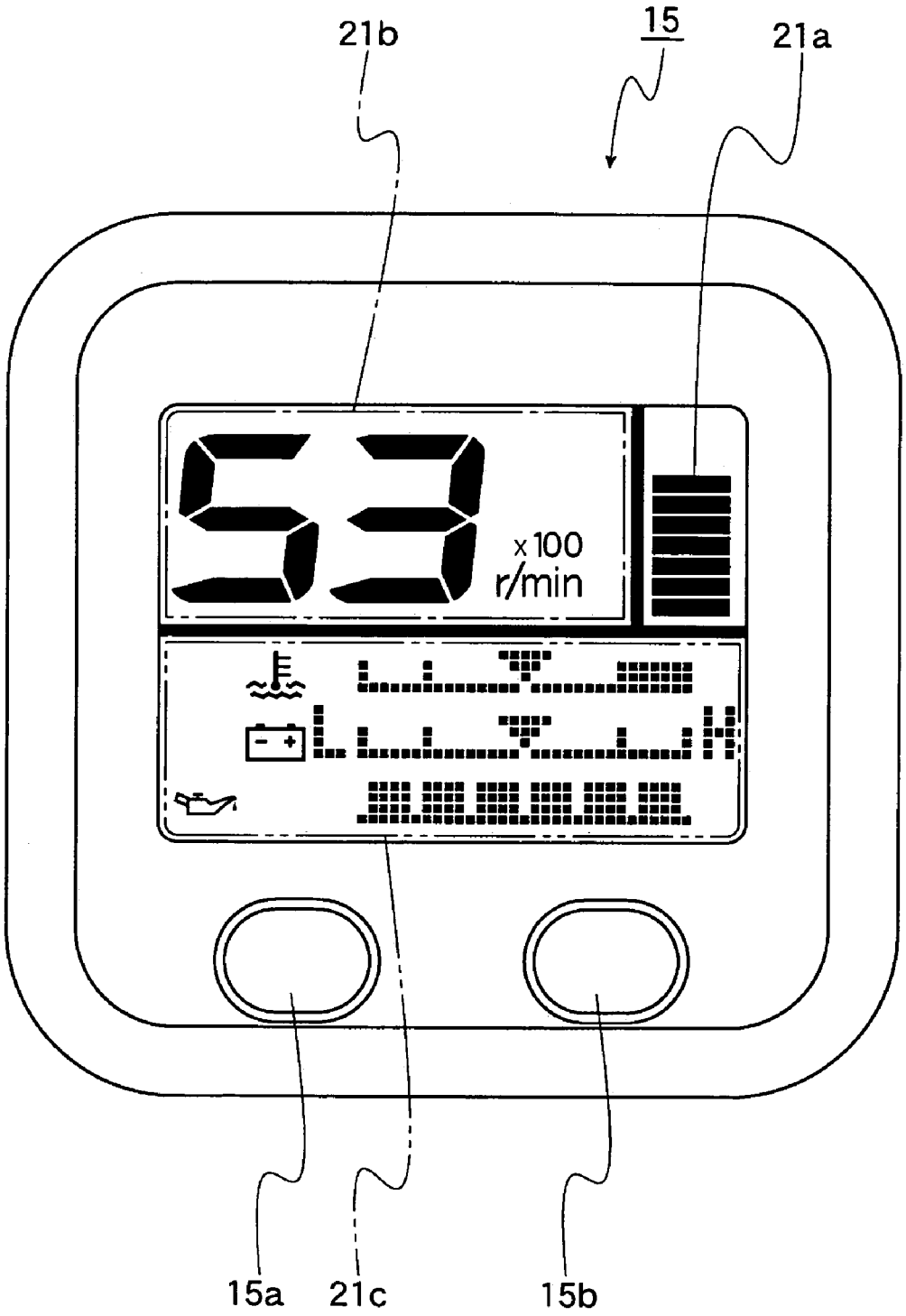
FIG. 2 is a front view of an embodiment of an indicating device of the trim angle correction indicating system, the indicating device having a trim angle indicating section.

As illustrated in FIG. 2, the indicating device 15 of the boat operating section 14 includes a trim angle indicating section 21*a* for indicating the trim angle of the outboard motor 11. The trim angle indicating section 21*a* is controlled by a trim angle indicator 21 shown in FIG. 6. The indicating device 15 also includes an engine speed indicating section 21*b* for indicating engine speed, and an engine condition indicating section 21*c* for indicating engine conditions such as cooling water temperature, hydraulic pressure, and the like. The indicating device 15 also includes input switches 15*a*, 15*b* for various input control operations such as switching between a normal mode and a setting mode.

The inboard network system is preferably configured such that each outboard motor 11 is coupled to a respective indicating device 15. The following discussion regarding one outboard motor 11 and one indicating device 15 is applicable to the other outboard motors 11 and respective indicating devices 15.

Figure 3:
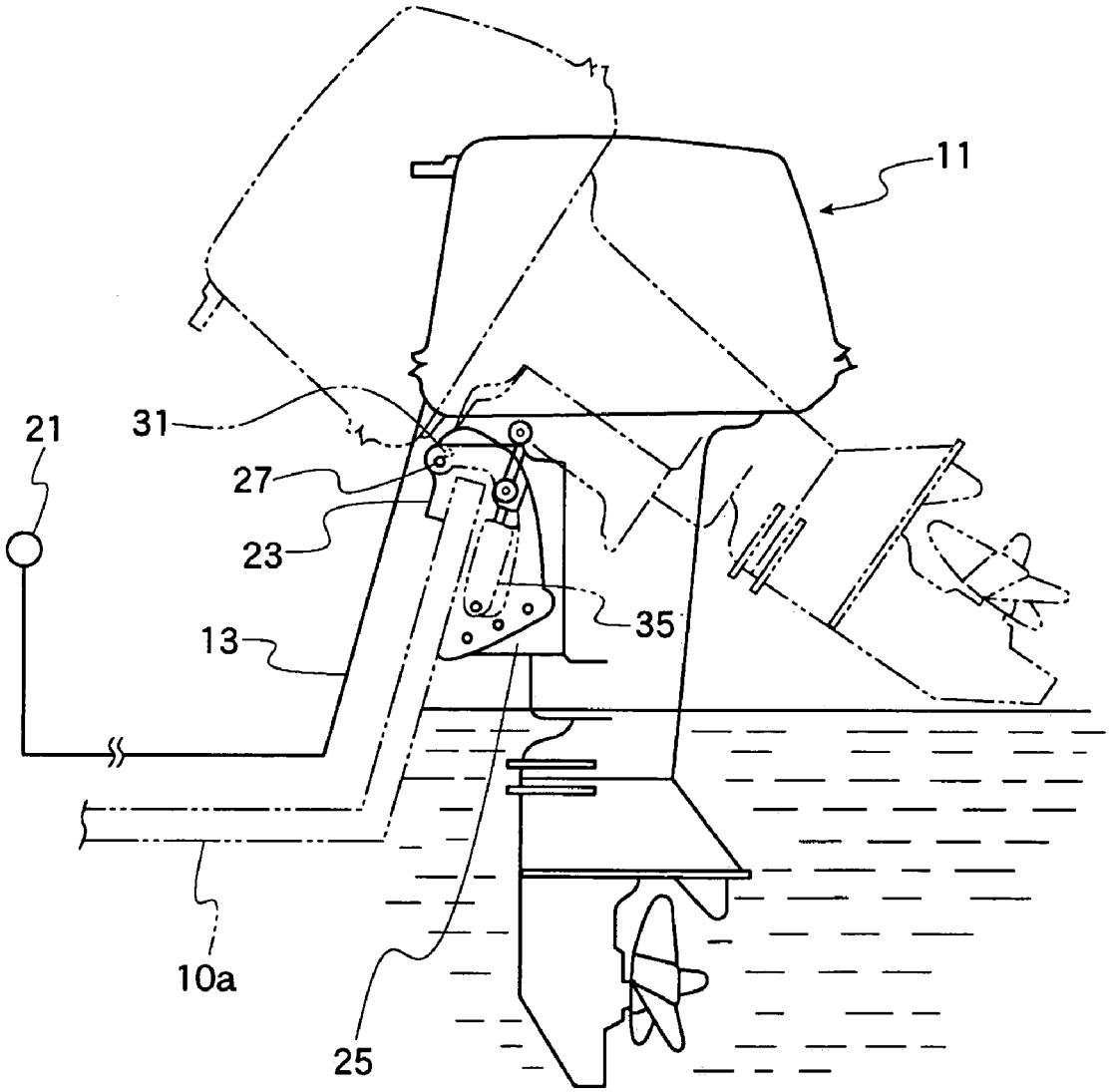
FIG. 3 is a side view of the boat of FIG. 1 (in partial cross section) and an outboard motor, the boat being equipped with an embodiment of the trim angle correction indicating system.
Figure 6:
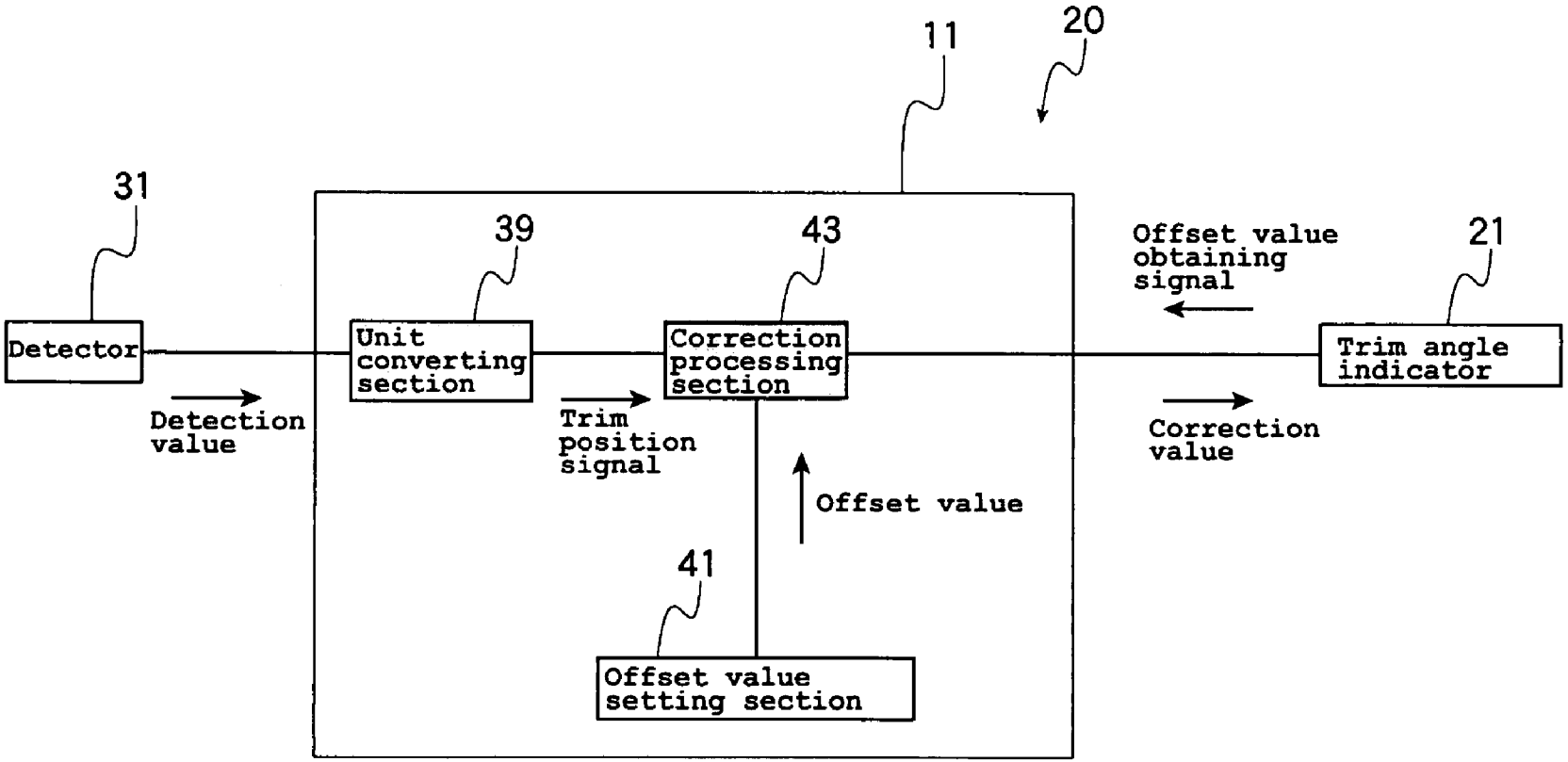
FIG. 6 is a block diagram of an embodiment of the trim angle correction indicating system for an outboard motor.

The trim angle of the outboard motor 11 is detected by a detector 31, which is located at the outboard motor 11 as shown in FIG. 3. The trim angle is indicated in the corresponding trim angle indicating section 21*a* (FIG. 2). As shown in FIG. 6, a trim angle correction indicating system 20 (FIG. 6) is interposed between the detector 31 and the trim angle indicator 21. As discussed below, the trim angle correction indicating system 20 corrects the detected trim angle so that the trim angle indicating section 21*a* accurately indicates the trim angle.

The outboard motor 11 is mounted on a rear portion of the hull 10*a* of the boat 10 in the manner illustrated in FIG. 3 so that the outboard motor 11 is rotationally movable with respect to the hull 10*a*. More specifically, a swivel bracket 25 is secured to the outboard motor 11, and a clamp bracket 23 is mounted on the hull 10*a*. The swivel bracket 25 and the clamp bracket 23 are connected by a tilt shaft 27 that enables the swivel bracket 25 to rotationally move with respect to the clamp bracket 23.

Figure 4:
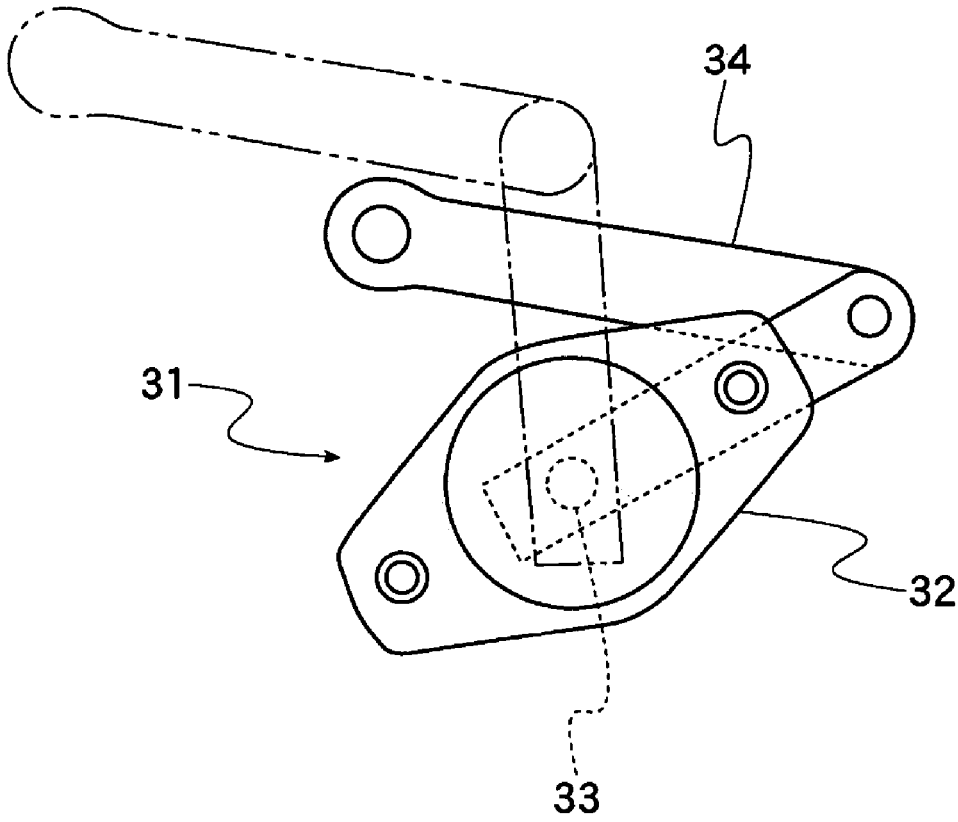
FIG. 4 is a front view of an embodiment of the detector of the trim angle correction indicating system.
Figure 5:
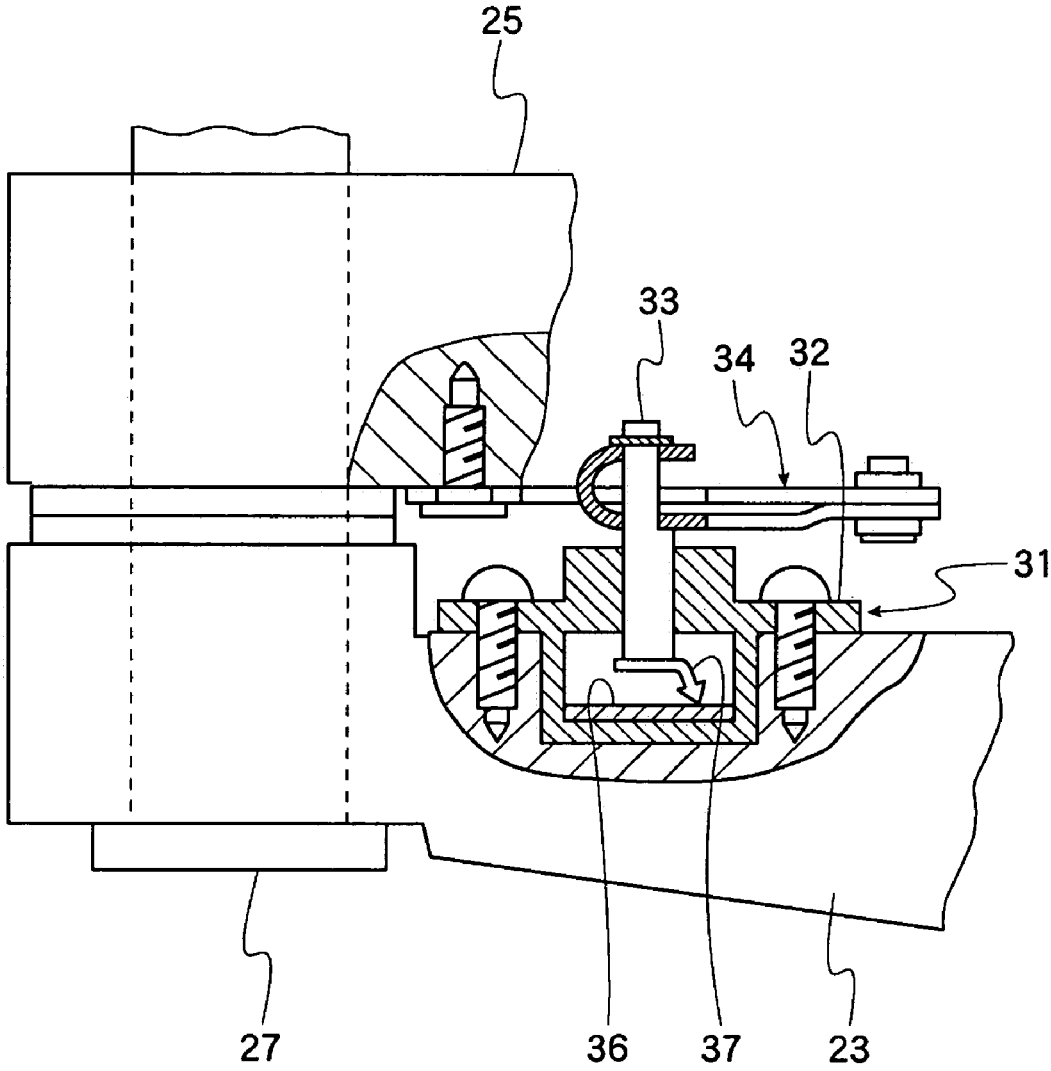
FIG. 5 is a partially sectional view of the detector of FIG. 4 mounted on the brackets supporting the motor of FIG. 3.

As shown in FIG. 4 and FIG. 5, the detector 31 comprises a base 32 and a detecting section 33. The base 32 is secured to the clamp bracket 23. The detecting section 33 is connected to the swivel bracket 25 through a linkage 34. The detecting section 33 is disposed on the base 32 for free rotational movement with respect to the base 32. As illustrated in FIG. 4, the linkage 34 has an original position (represented by solid lines and hidden lines). The linkage 34 moves to a second position (represented in phantom lines) in accordance with the rotational movement of the swivel bracket 25. The detecting section 33 rotationally moves with the linkage 34.

In FIG. 3, the lowest position at which the bottom of the outboard motor 11 is placed when the top of the outboard motor is raised vertically is shown by solid lines. This position is the full trim-in position, which is set as a reference position. A stopper (not shown) engages the swivel bracket 25 to stop the rotational movement of the outboard motor 11 when the outboard motor 11 is moved to the reference position.

As illustrated in FIG. 3, a cylinder device 35 tilts the outboard motor 11 from the reference position (solid lines) to a second position shown in phantom lines. As the outboard motor 11 is tilted to the second position, the detecting section 33 of the detector 31 rotationally moves relative to the base 32 (FIG. 4), and a contact point 37 (FIG. 5) moves with respect to a resistance plate 36 inside the detector 31. Thus, a resistance value changes in accordance with the displacement of the swivel bracket 25 relative to the clamp bracket 23. A voltage is responsive to the resistance value such that the value of voltage corresponds to the trim angle of the outboard motor 11. The value of the voltage is provided as an output of the detector 31 as a detection value. The detection value is transmitted to an engine control unit (ECU) of the outboard motor 11. A portion of the ECU is shown in FIG. 6.

The trim angle correction indicating system 20 is responsive to the detection value from the detector 31 to indicate the trim angle of the outboard motor 11 in the trim angle indicating section 21*a*. As shown in FIG. 6, the ECU of the outboard motor 11 includes a unit converting section 39 that receives the detection value from the detector 31 and converts the detection value to a trim position signal. The ECU also includes an offset value setting section 41 for setting a predetermined offset value. A correction processing section 43 in the ECU corrects the trim position signal of the detection value based on the offset value to provide a correction value. The correction value is sent to the trim angle indicator 21 via the network cable 13. The trim angle indicator 21 controls the trim angle indicating section 21*a* (FIG. 2) to indicate the trim angle of the outboard motor 11 based on the correction value.

In accordance with the described embodiment, the predetermined offset value is set as the detection value obtained from the detector 31 and converted to the trim position signal when the outboard motor 11 is placed at the reference position discussed above. As discussed above, the trim position signal is provided as an input to the trim angle indicator 21 via the inboard network system, and the trim angle indicating section 21*a* indicates the trim angle in response to the trim position signal.

In the disclosed embodiment of the trim angle correction indicating system 20, the indicating device 15 that includes the trim angle indicating section 21*a* also includes the switches 15*a*, 15*b* shown in FIG. 2. In one mode, the switches 15*a*, 15*b* function as part of an offset value obtaining instruction section 41. The switches 15*a*, 15*b* generate signals to cause the offset value setting section 41 to set an offset value. Thus, an operator of the indicating device 15 is able to set the offset value when the outboard motor 11 is placed at the reference position.

In accordance with a particular embodiment of the trim angle correction indicating system 20, the offset value setting section 41 sets the offset value to the value of the current detected trim position when the outboard motor 11 is at the reference position shown in FIG. 3. In order to mechanically specify the reference position, the trim angle correction indicating system 20 determines when the rotational movement of the outboard motor 11 is stopped at a specified position for a specified period of time.

To cause the trim angle correction indicating system 20 to set the offset value, the operator first controls the switches 15*a*, 15*b* of the indicating device 15 to switch to the mode for causing the offset value setting section 41 to set an offset value. Then, as shown in FIG. 6, an offset value obtaining signal is sent from the trim angle indicator 21 to the ECU of the outboard motor 11 via the network cable 13. The outboard motor 11 is then rotationally moved to the vertical reference position while the system is in the offset value setting mode. When the outboard motor 11 comes in contact with the stopper and stops, the outboard motor 11 is in the reference position. Since any further rotational movement of the outboard motor 11 is prevented by the stopper, the detection value obtained from the detector 31 is held at a constant value and does not change. Thus, the lapsing of a specified time with no changes in the detection value indicates that the outboard motor 11 is positioned at the reference position. The unchanging detection value obtained from the detector 31 is converted to a trim position signal by the unit converting section 39. While in this offset value setting mode, the offset value setting section 41 automatically sets this trim position signal as an offset value.

In an alternative embodiment, the stopper may be provided with a switch, for example, which is activated to detect when the outboard motor 11 is in the reference position.

After the outboard motor 11 has moved to the reference position and the offset value is set, the operator controls the switches 15*a*, 15*b* of the indicating device 15 to switch to the normal detection mode. In the normal detection mode, the trim angle of the outboard motor 11 is detected by the detector 31.

In the normal detection mode, the detection value detected by the detector 31 is sent to the ECU of the outboard motor 11 and converted to a trim position signal by the unit converting section 39. The trim position signal is then corrected by the correction processing section 43 based on the offset value set by the offset value setting section 41. In particular, the correction processing section 43 computes the difference between the two values, for example, so that a correction value is obtained. Then, the correction value is sent to the trim angle indicator 21 via the network cable 13, and the trim angle indicating section 21*a* indicates the trim angle of the outboard motor 11.

In the trim angle correction indicating system 20 described above, the offset value set by the offset value setting section 41 is the detection value obtained from the detector 31 when the outboard motor 11 is placed at the reference position. The correction processing section 43 corrects the detection value obtained from the detector 31 by using the offset value. Based on the correction value thereby obtained, the trim angle of the outboard motor 11 is indicated in the trim angle indicating section 21*a*. Therefore, the occurrence of misalignment of the detector 31 and deviation in the detection value obtained from the detector 31 caused by changes over time are compensated by the offset value. Correcting the detection value obtained from the detector 31 by using the offset value provides the correction value that compensates for such misalignment and deviation. Thus, when the trim angle of the outboard motor 11 is determined based on the correction value, the trim angle is accurately indicated in the trim angle indicating section 21*a*.

In the described embodiment, the detecting section 33, the offset value setting section 41, and the correction processing section 43 are located at the outboard motor 11. Therefore, misalignment, deviation in detection value, and the like, which occur only at the outboard motor 11 can be compensated at the outboard motor 11 so that an accurate correction value is obtained therefrom. Thus, the accurate correction value is always sent to the trim angle indicator 21. Therefore, there is no need to make any adjustment in the trim angle indicator 21 to compensate for misalignment and deviation which occur at the outboard motor 11. Accordingly, construction of the trim angle indicator 21 is simplified.

When the detector 31 and the trim angle indicator 21 are connected together via the network cable 13 in the manner described above, removal and replacement of the indicating device 15 having the trim angle indicator 21 is facilitated. Since the offset value is set at the outboard motor 11 side, the operator does not need to perform the foregoing operations to reset the offset value when the indicating device 15 is replaced. This feature facilitates easy replacement of the indicating device 15.

Although the offset value setting section 41 is disposed in the outboard motor 11, the switches 15*a*, 15*b* that the operator uses to cause the offset value setting operation to start are located in the indicating device 15 having the trim angle indicating section 21*a*. Therefore, the operator is able to activate the offset value setting mode while operating the boat. This feature enhances the operability of the trim angle correction indicating system 20.

As discussed above, the system is configured such that it has the stopper for stopping the rotational movement of the outboard motor 11 at the reference position. When the rotational movement of the outboard motor 11 is stopped at the reference position for a specified period of time, an offset value is set by the offset value setting section 41. This feature facilitates automatically detecting that the outboard motor 11 is placed at the reference position in order to set the offset value.

Figure 7:
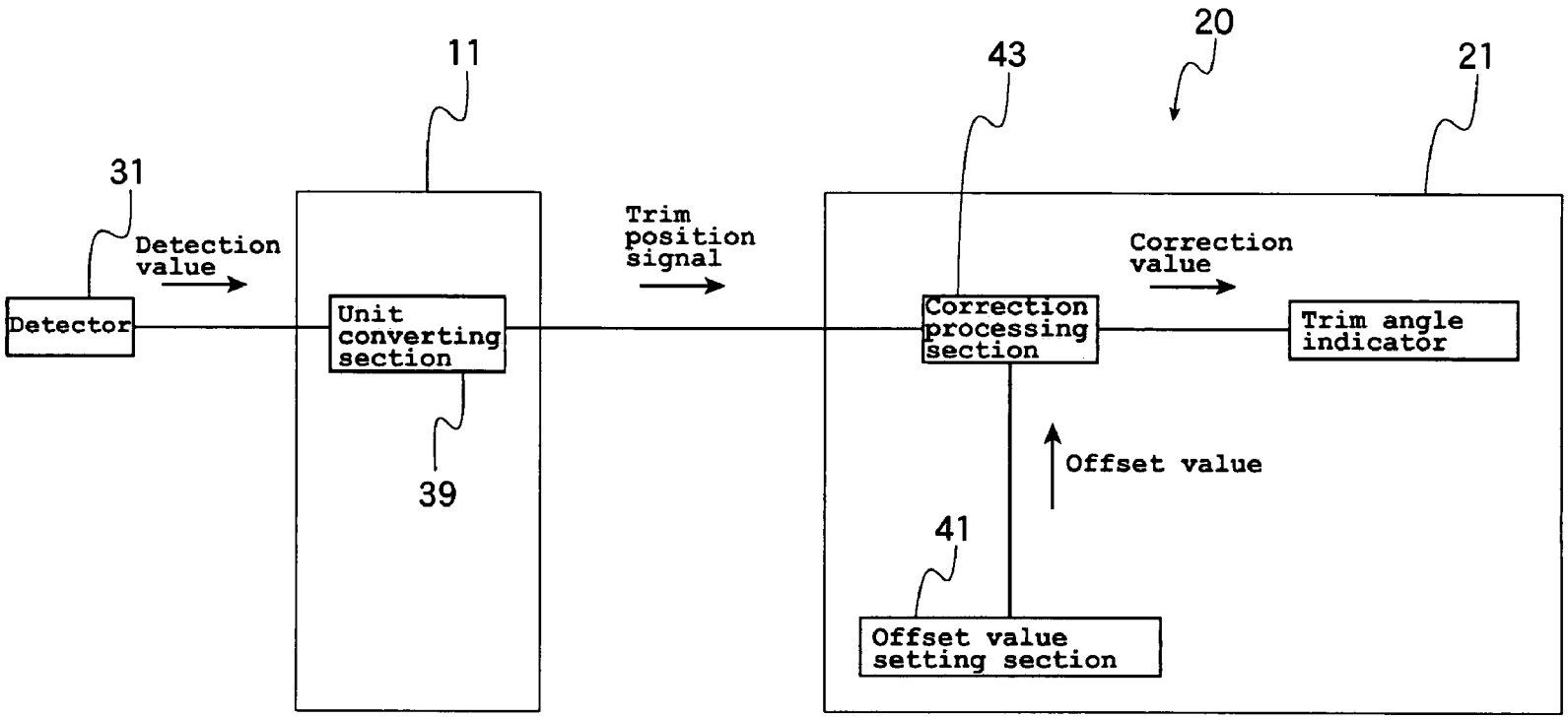
FIG. 7 is a block diagram of another embodiment of the trim angle correction indicating system for an outboard motor.

In the above-described embodiment, the offset value setting section 41 and the correction processing section 43 are both disposed in the outboard motor 11. FIG. 7 illustrates an embodiment in which the offset value setting section 41 and the correction processing section 43 are located in the trim angle indicator 21. In the embodiment of FIG. 7, the detection value is transmitted from the detector 31 to the ECU of the outboard motor 11, where the detection value is converted to a trim position signal by the unit converting device 39. Then, the trim position signal is sent to the indicator 21 via the network cable 13. The trim position signal is then corrected by use of the offset value set at the trim angle indicator 21 to determine the correction value. The trim angle indicating section 21*a* indicates the trim angle based on the correction value.

Aspects of the present invention may be embodied in other specific forms without departing from the essential characteristics as described herein. The embodiments described above are to be considered in all respects as illustrative only and not restrictive in any manner. The scope of the invention is indicated by the following claims rather than by the foregoing description. Any and all changes which come within the meaning and range of equivalency of the claims are to be considered within their scope.

What is claimed is:

1. A trim angle correction indicating system for an outboard motor, comprising:

a detector that detects the trim angle of an outboard motor and that generates a detection value;

an offset value setting section that sets as an offset value the detection value detected by the detector when the outboard motor is placed at a reference position;

a correction processing section that corrects the detection value detected by the detector based on the offset value set by the offset value setting section; and a trim angle indicating section that indicates the trim angle detected by the detector based on a correction value provided by the correction processing section correcting the detection value.

2. The trim angle correction indicating system for an outboard motor according to claim 1, wherein:

the detector is mounted to the outboard motor and is connected to the trim angle indicating section via a network; and the offset value setting section and the correction processing section are located in the outboard motor.

3. The trim angle correction indicating system for an outboard motor according to claim 2, further comprising switches located in the trim angle indicating section, the switches operable to cause the offset value setting section to start an offset value setting operation.

4. The trim angle correction indicating system for an outboard motor according to claim 3, further comprising a stopper to stop the rotational movement of the outboard motor at the reference position, the offset value setting section responsive to the outboard motor being stopped at the reference position for a specified time to set the offset value.

5. The trim angle correction indicating system for an outboard motor according to claim 2, further comprising a stopper to stop the rotational movement of the outboard motor at the reference position, the offset value setting section responsive to the outboard motor being stopped at the reference position for a specified time to set the offset value.

6. The trim angle correction indicating system for an outboard motor according to claim 1, further comprising a stopper to stop the rotational movement of the outboard motor at the reference position, the offset value setting section responsive to the outboard motor being stopped at the reference position for a specified time to set the offset value.

7. A trim angle correction indicating system for an outboard motor, comprising:

a detector that detects the trim angle of an outboard motor and that generates a detection value, the detector mounted to an outboard motor;

an offset value setting section that sets as an offset value the detection value detected by the detector when the outboard motor is placed at a reference position;

a correction processing section that corrects the detection value detected by the detector based on the offset value set by the offset value setting section; and a trim angle indicating section that indicates the trim angle detected by the detector based on a correction value provided by the correction processing section correcting the detection value, wherein the detector is connected to the trim angle indicating section via a network and wherein the offset value setting section and the correction processing section are located in the outboard motor.

8. The trim angle correction indicating system for an outboard motor according to claim 7, further comprising switches located in the trim angle indicating section, the switches operable to cause the offset value setting section to start an offset value setting operation.

9. The trim angle correction indicating system for an outboard motor according to claim 8, further comprising a stopper to stop the rotational movement of the outboard motor at the reference position, the offset value setting section responsive to the outboard motor being stopped at the reference position for a specified time to set the offset value.

10. The trim angle correction indicating system for an outboard motor according to claim 7, further comprising a stopper to stop the rotational movement of the outboard motor at the reference position, the offset value setting section responsive to the outboard motor being stopped at the reference position for a specified time to set the offset value.

11. The trim angle correction indicating system for an outboard motor according to claim 7, further comprising a stopper to stop the rotational movement of the outboard motor at the reference position, the offset value setting section responsive to the outboard motor being stopped at the reference position for a specified time to set the offset value.

* * * * *